United States Patent [19]

Leibinger et al.

[11] 4,044,215

[45] Aug. 23, 1977

[54] ELECTRIC SWITCH CONSTRUCTION HAVING AN EXTERNAL LOCKING MECHANISM

[75] Inventors: Paul Leibinger, Rietheim; Reinhold Mesle, Aldingen; Arnold Methner, Rietheim; Alfons Steidle, Spaichingen, all of Germany

[73] Assignee: J. and J. Marquardt, Rietheim, Germany

[21] Appl. No.: 555,825

[22] Filed: Mar. 6, 1975

[30] Foreign Application Priority Data

Mar. 7, 1974 Germany ..... 2410871

[51] Int. Cl.[2] ..... H01H 13/02

[52] U.S. Cl. ..... 200/318; 200/321

[58] Field of Search ..... 200/318, 321, 328

[56] References Cited

U.S. PATENT DOCUMENTS

| | | | |
|---|---|---|---|
| 3,194,084 | 7/1965 | Filander | 200/321 X |
| 3,217,559 | 11/1965 | Elligson | 200/321 X |
| 3,662,136 | 5/1972 | Bienwald et al. | 200/318 X |
| 3,869,591 | 3/1975 | Piber | 200/321 |

*Primary Examiner*—Robert K. Schaefer
*Assistant Examiner*—W. E. Duncanson, Jr.
*Attorney, Agent, or Firm*—McGlew and Tuttle

[57] ABSTRACT

An electric switch comprises a closed switch housing which is adapted to contain the switch contacts which has a guide bore for guiding a shaft portion of a switch operating member or push button. An operating member lock included an exterior housing portion associated with the switch housing which has a lock guide channel and a lock member bore intercepting the guide channel. The lock member is movable in the bore to engage a lock actuator which is connected to the switch operating member and is displaceable in the lock guide channel. The lock member is engageable with the lock actuator when the switch operating member is in an actuated position in order to lock the lock member and the switch operating member against movement.

8 Claims, 1 Drawing Figure

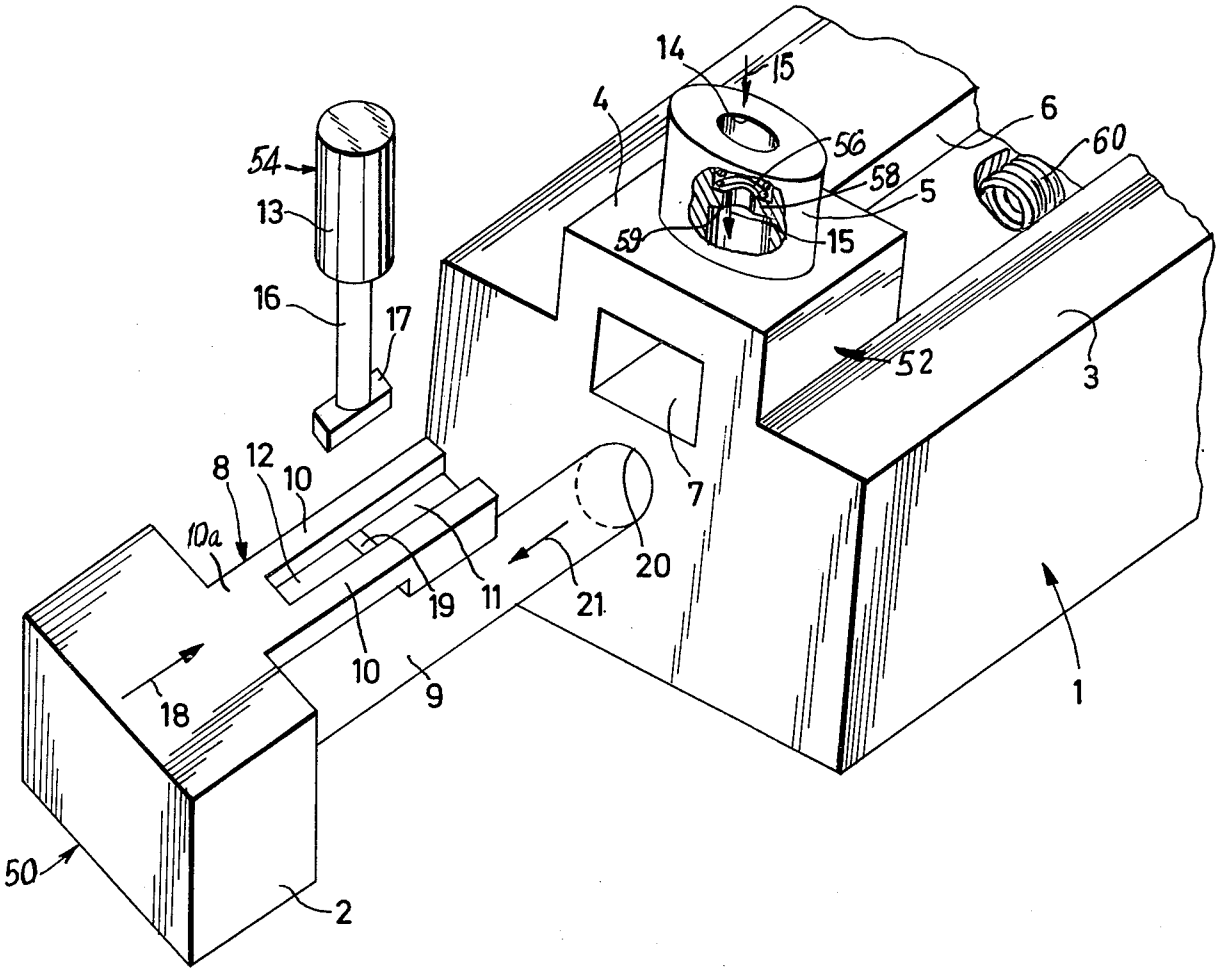
1
2
3
4
5
6
7
8
9
10
10a
11
12
13
14
15
16
17
18
19
20
21
50
52
54
56
58
59
60

ELECTRIC SWITCH CONSTRUCTION HAVING AN EXTERNAL LOCKING MECHANISM

BACKGROUND OF THE INVENTION

1. Field of the Invention

This invention relates in general to the construction of switches and in particular to a new and useful electrical switch having a locking mechanism for the actuating member which is mounted on the outside of the switch housing.

2. Description of the Prior Art

The present invention relates to an improved construction for electrical switch which has a locking mechanism for the actuating member of the switch. The known switches of this kind are of two general designs: In one of the designs the locking mechanism prevents an unintentional actuation of the switch and such mechanisms are used for example in electrically operated hand tools such as grinding, boring and similar tools. If such a tool is inadvertently laid down on its actuating member it may be started in a completely uncontrolled manner and this may lead to considerable accidents. On the other design the locking mechanism serves to retain the switch actuating member in its on or off position and for example to lock a button in its actuated position. Here again the field of application for such devices is generally for hand operated tools. In all of the known switches of this kind the actuating member projects at one location and the locking member projects at another location of the switch housing. Somewhere in the interior of the switch the two members can be interlocked. The disadvantage of such switches is that dust, moisture or the like can penetrate into the switch housing at the two locations. On the other hand up to date dust proof or dust tight switches are demanded more and more. If such switches are to be provided with additional locking mechanisms two sealing arrangements are necessary and such switches become very expensive to manufacture.

SUMMARY OF THE INVENTION

The present invention provides an electrical switch which includes a locking mechanism for the actuating member in an arrangement wherein expensive sealing in a dust proof manner of the switch operating mechanism may be carried out separately from the locking mechanism and in a simple and inexpensive manner.

In accordance with the invention a switch is provided having the entire locking mechanism mounted on the outside of the switch housing. Consequently with the inventive switch only the actuating member which in a purely mechanical actuation must necessarily extend through the switch housing is sealed against dust, moisture or the like while no sealing provisions are required for the locking mechanism itself.

In a preferred arrangement the locking mechanism comprises a connection member or lock actuator which is connected to the switch actuator for movement therewith and which may be engaged by a lock member which is movable transversely thereto in a guide associated with the switch housing. The guide is advantageously formed in a lock housing or extension on the outside of the switch housing and the lock member is easily movable in the bore of the guide housing which intercepts a guide channel for the lock actuator. In its location outside of the switch housing the locking mechanism does not have to be provided with any sealing provisions which is necessary for the locking mechanism inside the switch housing.

In a particularly preferred embodiment the locking mechanism comprises a connection member which extends parallel through the shaft of the switch actuator or push button and moves parallel to the shaft in its own guide. The locking member is carried in a bore which intercepts the guide channel for the lock actuator and it is movable transversely thereto. The locking member may be moved into engagement with the lock actuator after the switch is moved through a predetermined position for example an actuated position or a neutral position.

In accordance with one operating embodiment of the invention the switch actuating member is locked when it is moved to an actuated position and when the lock actuator is positioned so that an opening therein lies below a T-shaped end of lock member which may be moved so as to position the T-shaped end through the bore to lock the lock actuator member against withdrawal from the channel. The construction may be arranged however so that the T-shaped end of the locked member engages with the lock actuator only when the switch actuating member is moved to a different position for example an off position or neutral position.

The lock member is advantageously designed for use with a push button actuator which includes a shaft portion and guided in the switch housing and a lock actuator which extends parallel to the shaft and is guided in a guide channel formation on the exterior of the switch housing. The lock actuator plugs into a guide bore or channel which is arranged beneath a vertically extending bore carrying the lock member. The lock member is advantageously biased in an outward or non-locking position by an associated spring and it includes an end portion which is adapted to fit into an opening of the lock actuator when the opening is positioned at a selected location, for example when the switch is in a fully actuated position. When the lock member is plugged into the switch lock actuator the actuator cannot be moved and it may be maintained in this position for as long a period as necessary. For releasing the actuator is moved in a predetermined direction for example in a further direction toward the actuated position to release the lock member which then springs outwardly under the force of its biasing to release the switch actuating member.

The switch actuator advantageously includes a shaft portion which is biased in a direction opposite to the actuating direction by a reset spring. Similarly the locking member is also biased against movement to a locking position by its reset spring. The spring force of either the switch actuator or the locking member is not sufficient to relasee the locking and it supports the locking by biasing the parts in a locked interengaged position. The locking member can be returned to its initial non-locked position however simply by releasing the locking force of the reset spring acting on the switch actuator.

The lock member advantageously comprises a member having a cylindrical end forming a button type actuator with an opposite end with a T-shaped or plug-like extension which fits through a complementarily shaped opening in a lock actuator which is slidable with the switch actuating member. Both the lock member and the actuator are biased by spring force in a direction opposite to the locking direction. The reset spring for the switch actuator causes the locking interengagement of the lock actuator with the locking member and this biasing force may be overcome by pressing the switch in a direction against the spring to release the lock member and permit it to be sprung outwardly by its biasing spring.

The actuating member for the lock advantageously includes a pair of spaced parallel fork arms or prong-like portions which are bridged at their outer ends by a locking body. The lock member engageable end comprises a block shape member which fits between the fork arms behind the locking body in the locked position. When the locking body is aligned with the lock member there is not interengagement and there is interengagement only when the lock member engagement end fits into the opening between the arms inside of the locking body. The lock member engagement end is formed as a Tee-block which fits into a rectangular opening formed between the two forked arms.

It is particularly advantageous in accordance with the invention to make the lock mechanism housing as an upward formation on the switch housing which is formed as an integral part thereof and is preferably molded of a plastic material. The switch actuator is also made of a single plastic molded part and includes preferably the lock actuating member portion which is guided in the guide channel formed by the lock mechanism housing on the top of the switch housing.

Accordingly it is an object of the invention to provide an improved switch construction wherein the locking mechanism for locking the switch actuator in a selected position is formed as an external part of the switch so that it does not require any sealing within a switch housing.

A further object of the invention is to provide a switch construction which includes a switch housing having a lock housing formation formed as an integral part thereof and preferably as a molded part and which includes a button actuator which is slidable in the switch housing to actuate the switch contact parts and which also carries a lock actuator member which is slidable in a guide channel formed in the lock housing part above the switch housing and which is engageable with a lock member which is movable in a bore intercepting the channel to engage and lock the lock actuator when the switch actuator is in a predetermined position.

A further object of the invention is to provide an electrical switch construction which is simple in design, rugged in construction and economical to manufacture.

Fur an understanding of the principles of the invention reference is made to the following description of a typical embodiment thereof as illustrated in the accompanying drawings.

BRIEF DESCRIPTION OF THE DRAWINGS

The only FIGURE of the drawing is a partial front end perspective view of an electric switch constructed in accordance with the invention.

GENERAL DESCRIPTION OF THE PREFERRED EMBODIMENT

Referring to the drawings in particular the invention embodied therein comprises a switch construction which includes a switch housing generally designated 1 which contains therein contact elements which are moved into and out of contact engagement by means of a switch actuator generally designated 50. The switch actuator 50 in the embodiment illustrated includes a push button end 2 which is displaceable in an actuation direction indicated by the arrow 18 to move an actuator shaft portion 9 in respect to a bore 20 of the switch housing 1 in order to actuate the switch contact part (not shown).

In accordance with the invention the switch housing 1 is made integral with a lock mechanism housing generally designated 52 and is advantageously formed of a plastic material which is injection molded in a single piece. Lock mechanism housing 52 forms a channel or guideway 7 which has in the embodiment shown a rectangular cross section and provides a guide for a connecting member or lock actuating member generally designated 8 of the lock mechanism.

In accordance with a feature of the invention the lock actuator 8 is formed as an integral part of the actuating switch generally designated 50 and it advantageously may be formed in a single molded piece therewith. The lock actuating member 8 includes spaced apart parallel fork arms 10 which are bridged at their outer ends by a locking body 11 which faces downwardly toward the shaft 9. A rectangular space 12 is defined between the locking body 11 and the web portion **10*a* joining the arms 10, 10.**

In accordance with a feature of the invention the lock actuator 8 is held in a predetermined position of the actuating member 50 by a lock member generally designated 13 which includes a large diameter cylindrical button portiln 54 which extends upwardly in a bore 14 above the top of a raised cylindrical portion 5 of the locking mechanism housing 52. The lock member 13 also includes a shaft portion extending below the large diameter of the cylindrical portion 54 and connected at its lower end with an actuator member or lock shaped part 17. A compression spring 56 is located within the bore 14 and it is compressed between a ledge 58 and the bottom of the large diameter cylindrical portion 54 so as to urge the lock member 13 upwardly to project out of the bore 14 to an extent regulated by engagement of the lock part 17 with the lower portion 60 of the ledge 58.

When the switch is to be actuated the actuating member 50 is pushed inwardly in the direction of the arrow 18 by pushing the push button 2. This causes the block member 11 to move beyond the lock part 17 and permit it to be moved downwardly into the window or opening 12 and to rest beyond the edge 19 of the locking body 11 so as to prevent withdrawal of the actuator in a direction opposite the actuating direction 18.

In the lock position a spring 60 in the bore 20 urges the shaft portion 9 and the actuator 50 in the direction of the arrow 21 and causes the locking body 11 to become wedged against the shaft 16 of the lock member 13 so that the locked member 17 cannot be lifted upwardly out of the opening 12.

To release the actuator push button 2 is pushed in the direction of the arrow 18 to overcome the biasing force on spring 60 and to position the lock part 17 in alignment with the opening 12 so that it can move upwardly against the direction of the arrow 15 under the biasing action of the reset spring 56.

Because the entire locking mechanism 52 is located outside of the switch housing 1 no passage openings through the housing are needed and no sealing problems arise in respect to the lock mechanism itself. Only the shaft 9 of the actuator 50 need be sealed in respect to the bore 20 of the switch housing as is true with all conventional switches which have no locking mechanism.

While a specific embodiment of the invention has been shown and described in detail to illustrate the application of the principles of the invention, it will be understood that the invention may be embodied otherwise without departing from such principles.

What is claimed is:

1. A switch, comprising a closed switch housing adapted to contain the switch contacts and having a guide bore extending into said housing, a switch operating member having a shaft portion movable in the guide bore between at least two operating first and second positions one of which being an operative position of the switch contacts, an operating member lock including a lock housing associated with said switch housing having a lock guide channel and a lock member bore intercepting said guide channel, a lock member movable in the bore, and a lock actuator connected to said switch operating member and displaceable in the lock guide channel, said lock member being engageable with said lock actuator when said switch operating member is in a predetermined one of said first and second positions to lock said lock member and said switch operating member against movement, said switch actuating member including a push button portion connected to said shaft portion, said lock actuator including a portion extending from said push button substantially parallel to said shaft portion and engageable in said guide channel.

2. A switch according to claim 1, wherein said lock member comprises a push button having an inner end located in the guide channel with a locking part, said portion of said lock actuator which extends parallel to said shaft having a locking body extending across an inner end thereof, said locking part fitting behind said locking body to block movement of said lock actuator and said switch actuator.

3. A switch, comprising a closed switch housing adapted to contain the switch contacts and having a guide bore extending into said housing, a switch operating member having a shaft portion movable in the guide bore between at least two operating first and second positions one of which being an operative position of the switch contacts, an operating member lock including a lock housing associated with said switch housing having a lock guide channel and a lock member bore intercepting said guide channel, a lock member movable in the bore, and a lock actuator connected to said switch operating member and displaceable in the lock guide channel, said lock member being engageable with said lock actuator when said switch operating member is in a predetermined one of said first and second positions to lock said lock member and said switch operating member against movement, wherein said lock actuator comprises a connecting member having a pair of spaced apart fork arms interconnected at their outer ends by a web portion and a locking body bridging the outer end of said fork arms and defining an opening between said arms between said locking body and said web portion, said locking member comprising an outer cylindrical portion forming an actuating button, spring means biasing said button outwardly and an inner portion with a block shape locking part engageable in the opening between said fork arms to block said lock actuator and prevent movement of said switch actuator member.

4. A switch according to claim 3, wherein said block body is connected to said fork arms at the side thereof facing said switch operating member shaft portion and a push button portion connected between said lock actuator and said shaft portion.

5. A switch, comprising a closed switch housing adapted to contain the switch contacts and having a guide bore extending into said housing, a switch operating member having a shaft portion movable in the guide bore between at least two operating first and second positions one of which being an operative position of the switch contacts, an operating member lock including a lock housing associated with said switch housing having a lock guide channel and a lock member bore intercepting said guide channel, a lock member movable in the bore, and a lock actuator connected to said switch operating member and displaceable in the lock guide channel, said lock member being engageable with said lock actuator when said switch operating member is in a predetermined one of said first and second positions to lock said member and said switch operating member against movement, wherein said lock housing comprises an exterior formation on said switch housing having a rectangular channel therethrough formingsaid guide channel and a guide sleeve connected downwardly into said formation and having a bore comprising the bore for said lock member.

6. An electric switch according to claim 5, wherein said switch housing and said lock housing are formed as an integral molded part including an upstanding block projection on said switch housing with a bore therethrough defining said guide channel and a cylindrical portion extending downwardly into said block shaped portion having a bore therethrough defining the bore for said lock member.

7. A switch according to claim 5, wherein said lock actuator and said switch actuator member comprises a single plastic molded part.

8. A switch, comprising a closed switch housing adapted to contain the switch contacts and having a guide bore extending into said housing, a switch operating member having a shaft portion movable in the guide bore between at least two operating first and second positions one of which being an operative position of the switch contacts, an operating member lock including a lock housing associated with said switch housing having a lock guide channel and a lock member bore intercepting said guide channel, a lock member movable in the bore, and a lock actuator connected to said switch operating member and displaceable in the lock guide channel, said lock member being engageable with said lock actuator when said switch operating member is in a predetermined one of said first and second positions to lock said lock member and said switch operating member against movement, wherein said lock member comprises a push button, means biasing said push button to project outwardly from said lock housing, said lock actuator and said switch actuator being formed as a single molded part including an outer push button portion with a shaft portion extending inwardly to said housing from said push button portion and a forked arm portion forming said lock actuator extending inwardly from said push button portion parallel to said shaft portion.

* * * * *